US005970775A

United States Patent [19]

McClung

[11] Patent Number: 5,970,775

[45] Date of Patent: Oct. 26, 1999

[54] METHOD AND APPARATUS FOR FORMING CUP-SHAPED CONTAINER BODIES

[75] Inventor: James A. McClung, North Canton, Ohio

[73] Assignee: Can Industry Products, Inc., Canton, Ohio

[21] Appl. No.: 09/132,269

[22] Filed: Aug. 11, 1998

[51] Int. Cl.[6] ..... B21D 45/06

[52] U.S. Cl. ..... 72/344; 72/347

[58] Field of Search ..... 72/336, 344, 345, 72/347, 349, 701

[56] References Cited

U.S. PATENT DOCUMENTS

| | | | |
|---|---|---|---|
| 2,168,300 | 8/1939 | Lemming | 72/344 |
| 3,902,347 | 9/1975 | Ridgway et al. | 72/336 |
| 4,026,140 | 5/1977 | Saunders | 72/344 |
| 4,214,471 | 7/1980 | Bulso, Jr. et al. | 72/349 |
| 4,343,173 | 8/1982 | Bulso, Jr. et al. | 72/345 |
| 4,796,454 | 1/1989 | Bulso, Jr. et al. | 72/350 |
| 5,626,048 | 5/1997 | McClung | 72/336 |

*Primary Examiner*—Lowell A. Larson
*Attorney, Agent, or Firm*—Sand & Sebolt

[57] ABSTRACT

Apparatus and method for forming cup-shaped container bodies in a press by blanking a disk shaped metal blank from a flat metal sheet by a cutting die and forcing the disk blank through a blank and draw die by movement of a draw horn to form a generally cylindrical-shaped can body. Next, the cylindrical shaped body is moved by pressurized air through the bore of a cylindrical-shaped cup drop sleeve. The cup drop sleeve has an inner diameter just slightly larger than the outer diameter of the just formed cylindrical metal body thereby reducing the amount of spring back in the metal and setting the metal in the formed body to reduce distortion and maintain roundness thereof as the body is being ejected through the open bottom of the drop sleeve.

20 Claims, 7 Drawing Sheets

METHOD AND APPARATUS FOR FORMING CUP-SHAPED CONTAINER BODIES

BACKGROUND OF THE INVENTION

1. Technical Field

The invention relates to forming cup-shaped cylindrical members such as container bodies, from a blank of metal, and in particular to forming such bodies in a press which increases the roundness of the cylindrical-shaped sidewall of the body by reducing distortion thereof after the formed body passes through a cup drop sleeve by providing the cup drop sleeve with an internal diameter just slightly greater than the outer diameter of the cylindrical sidewall of the cup body formed by the die opening of the blank and draw die to reduce the spring back of the just formed cylindrical cup body.

2. Background Information

It is well known in the container forming art to form two-piece containers, that is, containers in which the sidewall and bottom wall of the container bodies are one-piece members and the top or end closure is a separate piece, by stamping disc-shaped blanks from a strip of sheet metal and then subsequently drawing the blank disc into a cylindrical cup-shaped body. In many can body forming presses, a generally cylindrical-shaped first stage body is ejected through a cylindrical cup drop sleeve by downward movement of a draw horn in combination with pressurized air, afterwhich the formed body is deposited on a pallet or a conveyor for subsequent forming or reforming to provide the final shape and size of can body.

It is desirable that the first stage cup-shaped body be as uniform in its roundness or cylindrical configuration as possible after ejection from a first stage press to provide for a more uniform can body prior to being fed into a subsequent reforming press. However, the flat blank disc when formed into a first stage cylindrical cup-shaped body by a blank and draw die and draw horn has the natural tendency or elasticity to spring back toward its original shape and distort into a somewhat oval shape due to the natural elasticity of the metal, which just prior to being formed into the generally cylindrical-shaped member, was a flat sheet. Heretofore, the cup drop sleeve of a press had an internal diameter relatively larger than the outer diameter of the just drawn cylindrical cup-shaped body to permit the first stage body to move freely therethrough, usually by pressurized ejection air which is emitted from openings in the draw horn.

The above forming and ejection operations occur in fractions of a second from the time the flat metal sheet is cut into a blank disc and then drawn into the first stage cup-shaped body which prevents the metal from setting sufficiently in its newly formed cylindrical shape to eliminate the spring back and distortion of the metal as it is ejected from the cup drop sleeve.

Therefore, it is desirable to develop an improved method and apparatus which reduces the distortion and spring back of a just formed cylindrical first stage cup-shaped metal blank upon being ejected from a first stage press without effecting the output speed, quantity and operation of the forming press.

SUMMARY OF THE INVENTION

Objectives of the invention include providing an improved apparatus and method for forming cup-shaped container bodies, preferably in a double acting press, from sheet metal material, wherein the material is blanked and drawn into a generally cylindrical cup-shaped configuration in a single stroke of the press, wherein the blank cup moves through a cup drop sleeve usually by air pressure, with the internal diameter of the drop sleeve being just slightly greater than the outer diameter of the cup-shaped blank formed by the blank and draw die and draw horn, to reduce the spring back of the metal and to enable the blank cup to maintain a more uniform cylindrical configuration and roundness than heretofore possible.

Another objective is to provide an improved method and apparatus in which the entrance end opening of the cup drop sleeve is outwardly flared or tapered to assist in guiding the just formed cup-shaped blank into the interior of the cup drop sleeve.

A further objective of the invention is to provide such a method and apparatus in which the cup drop sleeve has an axial length approximately two times the axial length of the cup being formed by the press and drop sleeve.

These objectives and advantages are obtained by the improved method of the invention for forming a cup-shaped body, the general nature of which may be stated as including the steps of feeding the metal sheet between a blank and draw die and an aligned draw horn, a pressure-actuated draw pad and a cut edge; providing the blank and draw die with a cup forming opening formed by a first cylindrical inner wall having a diameter (D); providing a cup drop sleeve with a cylindrical inner opening formed by a cylindrical inner surface aligned with the draw horn, said opening having an inner diameter (Id); advancing the cut edge and draw pad toward the metal sheet and the blank and draw die and blanking a disk from the metal sheet; clamping a periphery of the disk between the draw pad and the blank and draw die; advancing the draw horn towards the blank and draw die; drawing the cup-shaped member from the disk by the advancement of the draw horn into the cup forming opening of the blank and draw die; forcing the cup-shaped member through the cylindrical inner opening formed in the cup drop sleeve by directing a flow of pressurized air against the cup-shaped member; and forming the inner diameter (Id) of the cup drop sleeve greater than the diameter (D) of the blank and draw die opening by an amount within the range of 0.040 inches and 0.001 inches.

These objectives and advantages are further obtained by the improved apparatus of the invention, the general nature of which may be stated as including a draw pad and a draw horn; a blank and draw die mounted on a base in opposed relationship to the draw pad and draw horn, said die having a first cylindrical inner wall forming a cup forming opening, said wall opening having a diameter (D); a cutting edge carried by ram means and surrounding the draw pad and draw horn for cutting a disk from the metal sheet; means for applying a clamping force on the draw pad for clamping a periphery of the disk between the draw pad and blank and draw die and for drawing the disc-shaped blank into a generally cylindrical cup-shaped body; a cup drop sleeve mounted in the base beneath the draw horn, said drop sleeve having a cylindrical inner surface having an internal diameter (Id) forming an opening, said (Id) being between 0.040 inches and 0.001 inches greater than the diameter (D) of the cup forming opening; and air ejection means for forcing the cup-shaped blank through the cup drop sleeve opening.

BRIEF DESCRIPTION OF THE DRAWINGS

A preferred embodiment of the invention, illustrative of the best mode in which applicant has contemplated applying the principles, is set forth in the following description and is shown in the drawings and is particularly and distinctly pointed out and set forth in the appended claims.

Similar numerals refer to similar parts throughout the drawings.

DESCRIPTION OF THE PREFERRED EMBODIMENT

Figure 1:
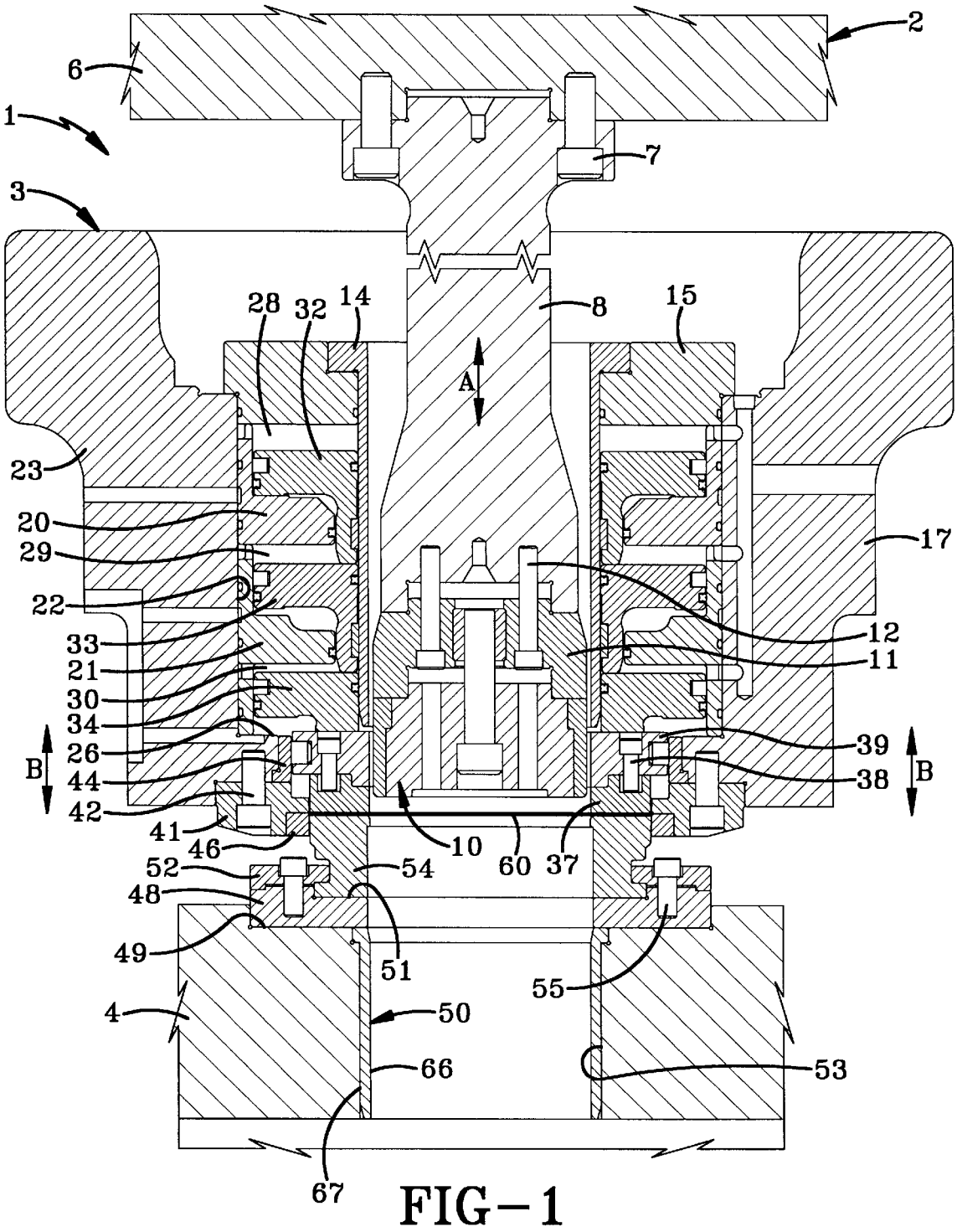
FIG. 1 is a schematic sectional view of a portion of the apparatus for carrying out the method of the present invention for forming the cup-shaped member at the start of the forming operation.

The method and apparatus of the present invention preferably are utilized in conjunction with a double acting press although the same could be used in a single acting press without departing from the concept of the invention. The double acting press is indicated generally at 1 (FIG. 1), and includes an inner ram 2 and an outer ram 3 movable toward and away from a generally fixed base 4. The complete press will not be described in detail since such double acting presses are well known in the art and are exemplified in U.S. Pat. No. 3,902,347, the contents of which are incorporated herein by reference. These presses have a capability of independently controlling the movement of their rams and the tooling associated therewith. The particular press and the means of applying the necessary clamping pressure as shown in the drawings can be of the type shown in U.S. Pat. No. 5,626,048, the contents of which are also incorporated herein by reference.

Referring to the drawings, inner ram 2 includes an inner punch holder 6 which is connected by bolts 7 to an inner punch risers 8. In the particular press shown in the drawings, a draw horn 10 is mounted by a horn spacer 11 to inner punch riser 8 by a plurality of bolts 12 and has a hardened outer shell 13 secured thereto. Inner punch riser 8 thus will move draw horn 10 in a reciprocal vertical direction upon movement of inner ram 2 as shown by arrow A. A cylindrical guide sleeve 14 surrounds draw horn 10 and is connected to an annular end cap 15 which is connected to an annular outer ram housing 17 by bolts or other attachment means, which housing is moved vertically by outer ram 3 as shown by arrows B.

A pair of annular cylinders indicated generally at 20 and 21 are mounted in a vertical stacked relationship within an annular bore 22 of an outer ram housing 23 and are clamped in position between end cap 15 and an inwardly extending annular shoulder 26 formed at the lower end of ram housing 23. Thus, cylinders 20 and 21 move in unison with outer housing 17 upon actuation of outer ram 3. Cylinders 20 and 21 form a stacked array of annular pressure chambers 28, 29 and 30 within bore 22 of ram housing 17. Annular pistons 32, 33 and 34 are independently movable within each pressure chamber 28, 29 and 30 respectively. The details of operation and advantages achieved by this piston arrangement are shown and described in detail in U.S. Pat. No. 5,626,048 but can be replaced by other types of pressure means without affecting the concept of the present invention.

An annular draw pad 37 is secured by bolts 38 to an annular mounting ring 39 which is operatively engageable with lower most piston 34. An annular retainer ring 41 is mounted by bolts 42 to the lower end of outer ram housing 17 and clamps an annular wear sleeve 44 between housing 17 and draw pad mounting ring 39. An annular cut edge 46 is mounted within a recess formed in retainer ring 41 and is also slidably engaged with respect to draw pad 37. These various components discussed above are all standard in the press art and their features and functions are well known to those skilled in the art. Thus their exact constructions and manner of operation are not described in further detail.

Base 4 which is indicated as being a fixed base, could be fluidly supported if desired in order to reduce the forces exerted thereon and to compensate for thermal expansion without affecting the concept of the invention. A blank and draw die retainer ring 48 is mounted within an annular recess 49 formed in base 4 and secures a cup drop sleeve 50 within a cylindrical opening 53 formed in base 4. An annular draw die clamp 52 secures an annular blank and draw die 54 into an annular recess 51 formed in retainer ring 48 by a plurality of bolts 55.

The general operation of press 1 is similar to that described in U.S. Pat. No. 5,626,048 as well as utilized in most double acting presses. FIG. 1 shows the position of the various components at the start of a cycle for forming a container body from a continuous strip of material such as steel or aluminum. The outer ram has moved downwardly toward base 14 and the cut edge 46 has moved along the outer periphery of blank and draw die 54 to form disc-shaped blank 60 from the metal sheet and the clamping pressure has been applied to the draw pad clamping the disc against blank and draw die 54.

Figure 2:
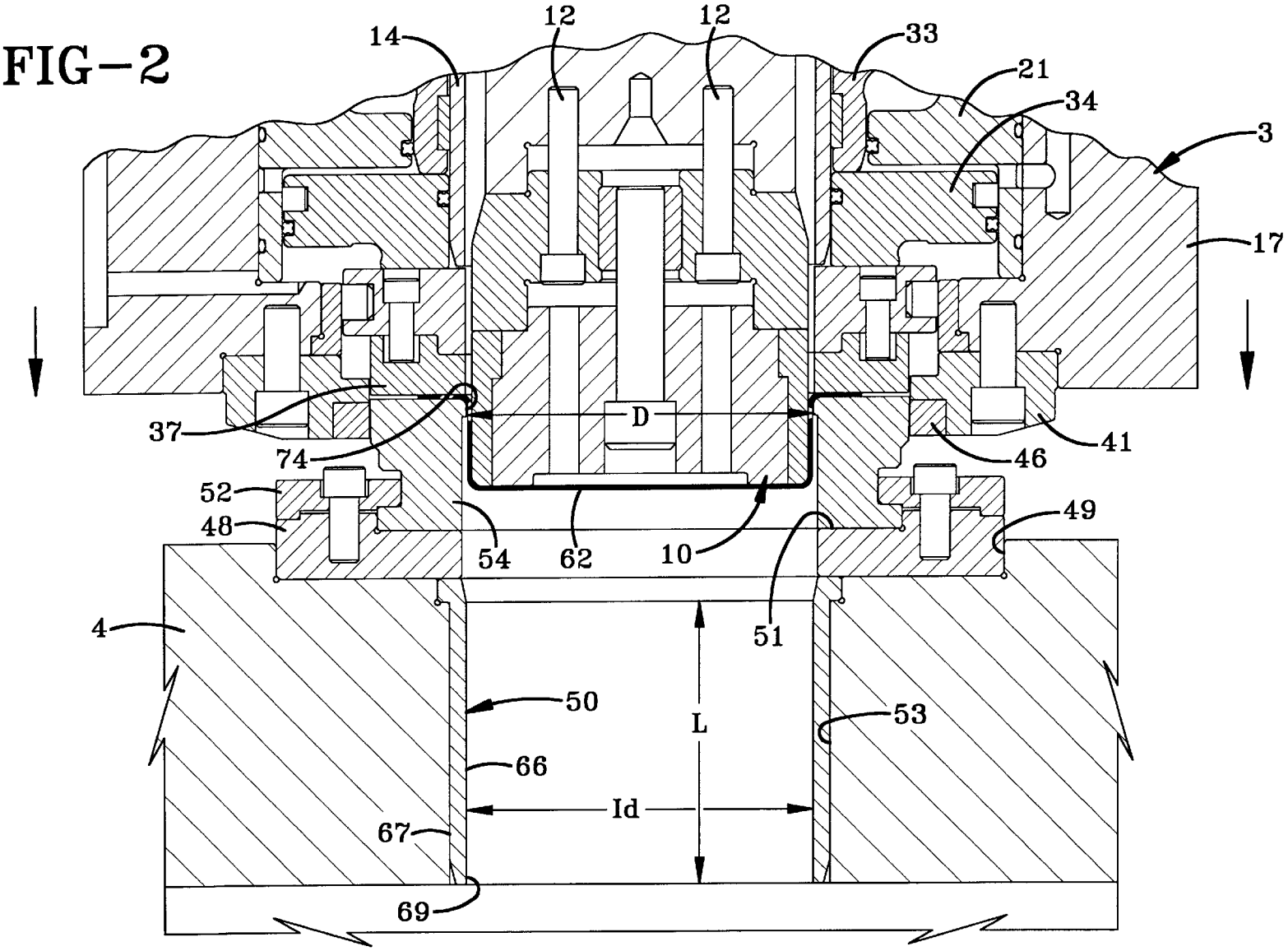
FIG. 2 is an enlarged fragmentary sectional view of FIG. 1 showing the disc blank being partially formed into a cup-shaped member by an advancing draw horn.
Figure 3:
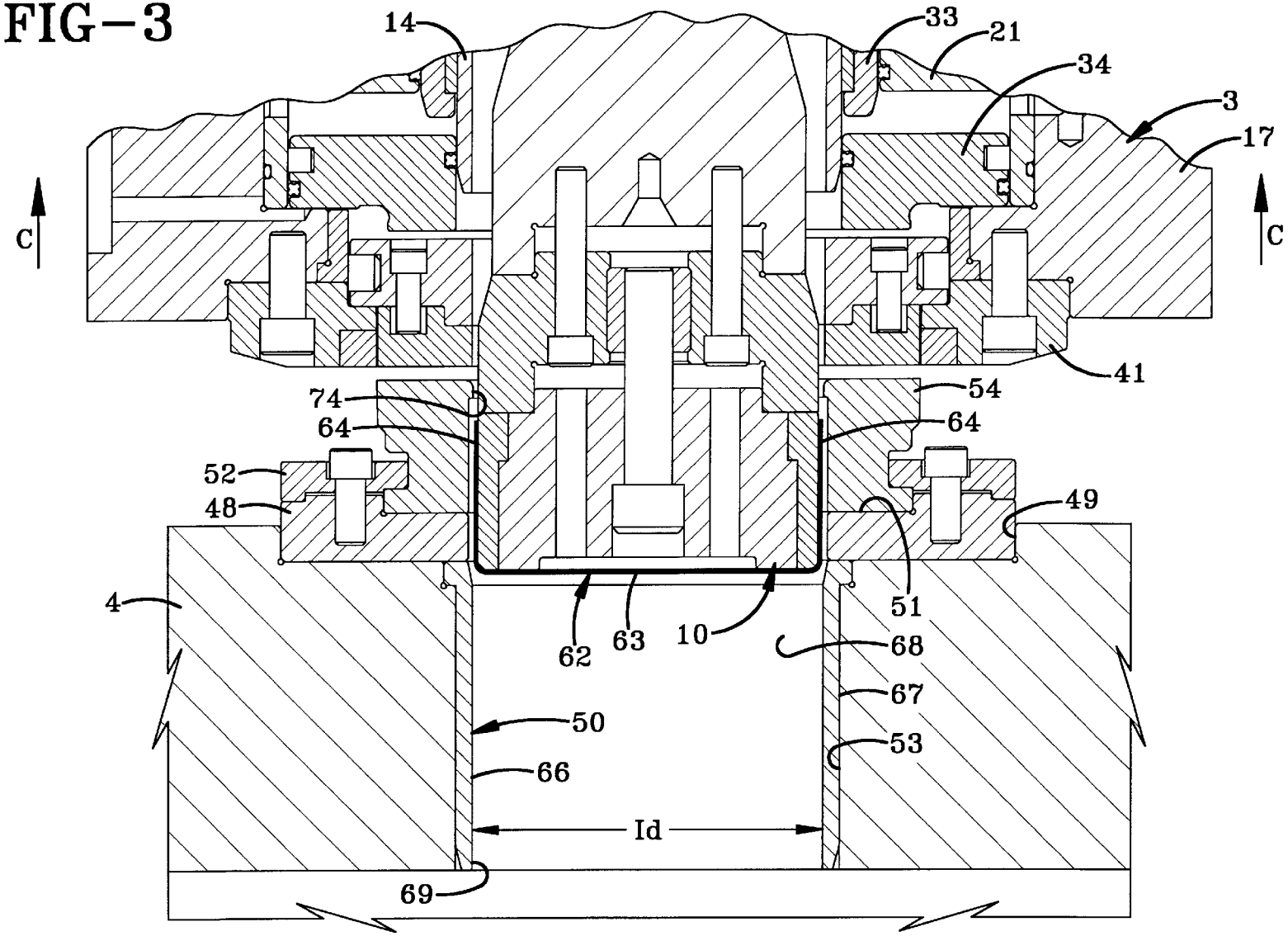
FIG. 3 is a view similar to FIG. 2 showing the draw horn at the end of its stroke after forming the cup-shaped member.
Figure 4:
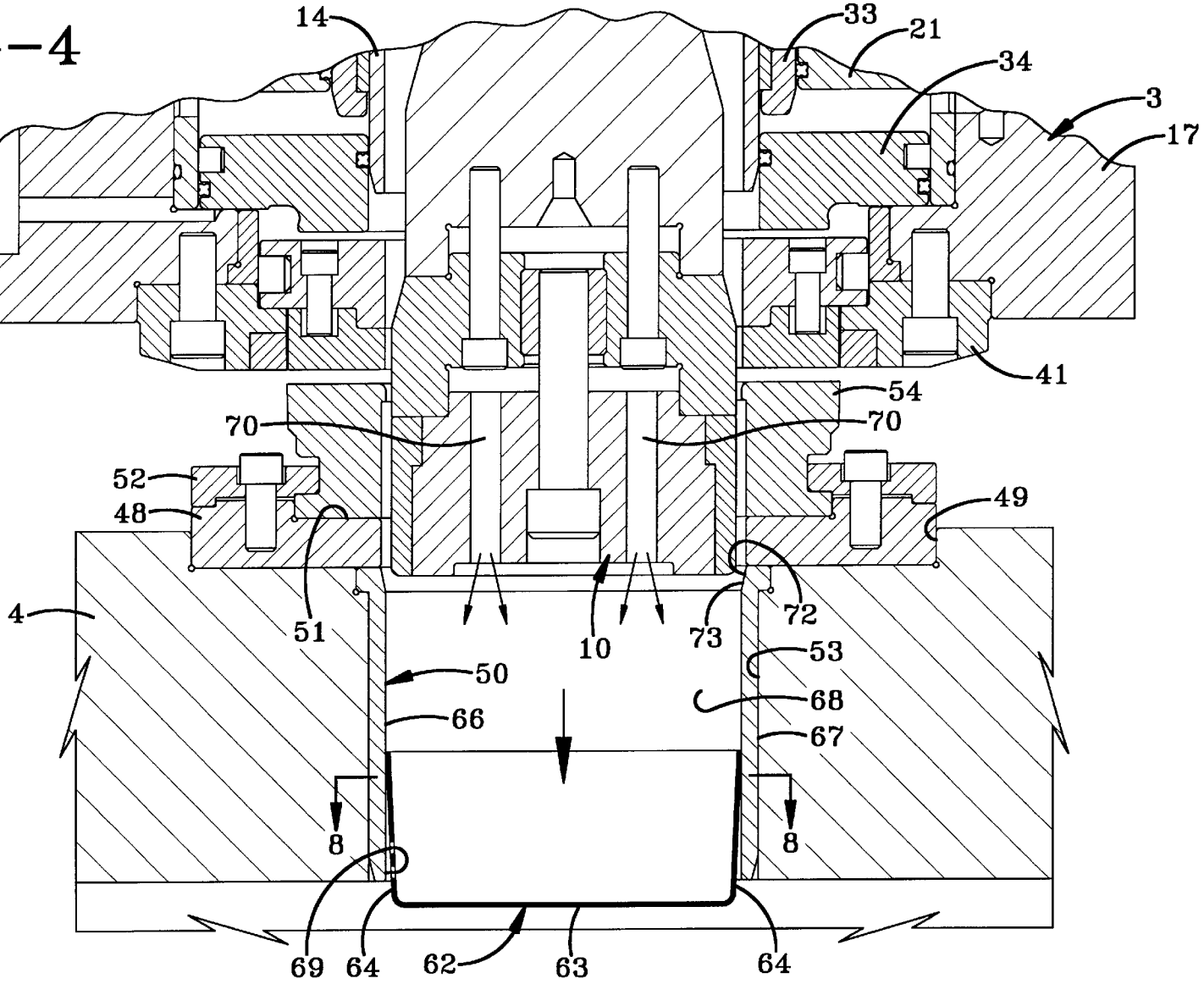
FIG. 4 is a view similar to FIGS. 2 and 3 showing the first stage cup-shaped member of FIG. 3 moving through the cup drop sleeve.

FIG. 2 shows the position of the various components wherein draw horn 10 and the piston array has drawn disk blank 60 into a partially formed cup-shaped body 62 with the outer ram being in its bottom dead center position. FIG. 3 shows the position of the various press components upon draw horn 10 reaching its lower most position and draw pad 37 starting to retract in an upward direction as shown by arrows C. As shown in FIG. 3, cup-shaped body 62 will have a generally cylindrical configuration with a bottom wall 63 and a cylindrical sidewall 64. FIG. 4 shows the cup-shaped body 62 just prior to being ejected from the bottom discharge opening 69 of cup drop sleeve 50.

In accordance with the invention which is best shown in FIGS. 5–9, cup drop sleeve 50 has a cylindrical configuration with an inner surface 66 and an outer surface 67, wherein outer surface 67 is complementary to opening 53 formed in base 4 and is slidably received therein as shown in FIGS. 1–4. The internal diameter (Id) in sleeve 50 defined by inner surface 66, is slightly larger than the final outer diameter (Od) of cup-shaped cylindrical sidewall 64 (FIG. 9) and of the diameter (D) of die opening 61 of blank and draw die 54. Die opening diameter (D) is the diameter of cylindrical surface 74. Thus, as body 62 is forced through the internal opening or bore 68 of sleeve 50 by blasts of pressurized air indicated by the arrows (FIG. 4) which moves through air passages 70 formed in draw horn 10, cylindrical sidewall 64 of body 62 is constricted and formed into a truer more cylindrical annular configuration by preventing the natural tendency of the just formed metal cylinder from springing outwardly and distorting, thereby providing a more uniform accurately controlled cup-shaped body than heretofore possible in prior art presses wherein the internal diameter of the drop sleeve was at least equal to and usually larger than the outer diameter of the just formed cylindrical cup-shaped body.

Figure 8:
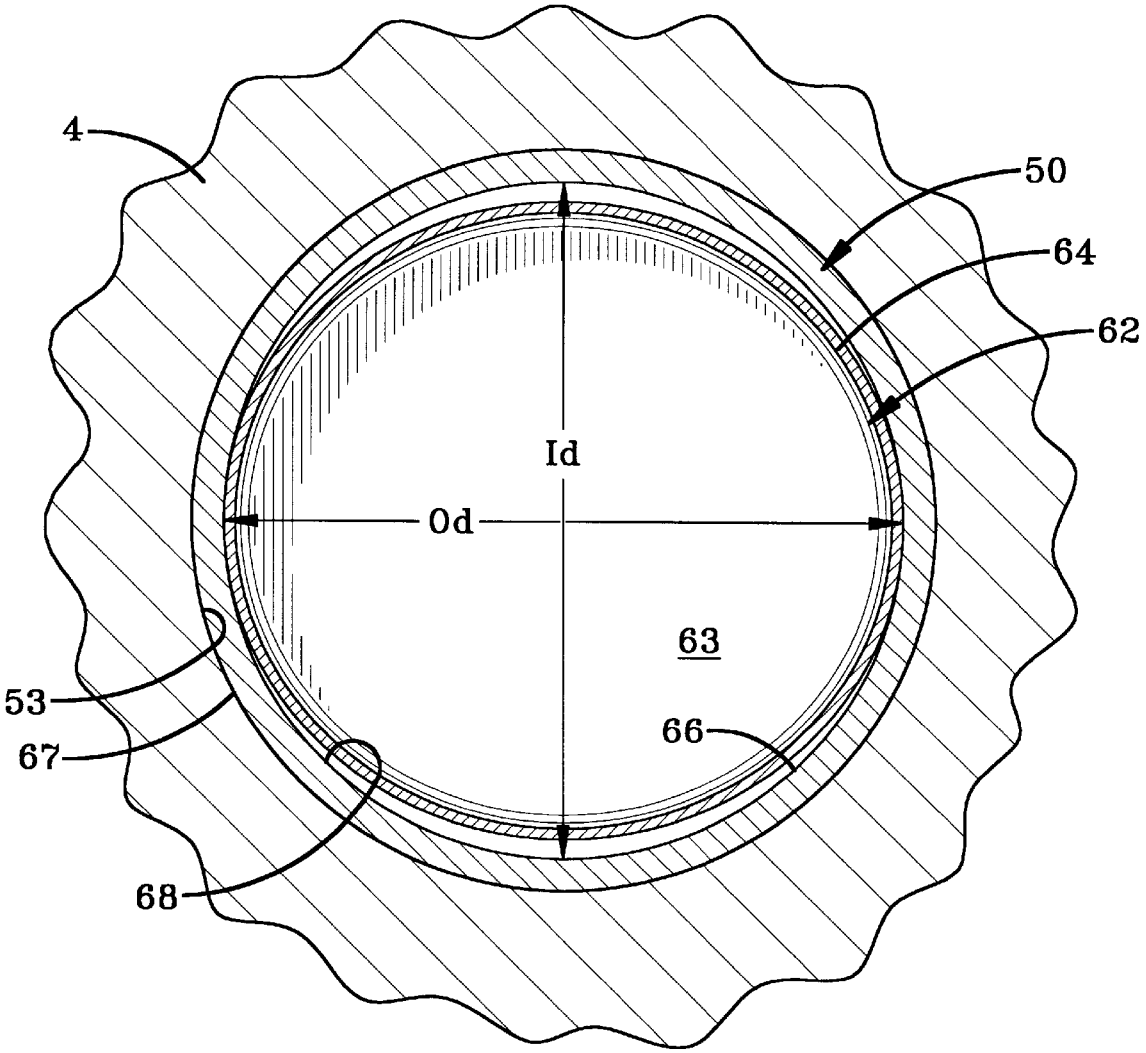
FIG. 8 is an enlarged fragmentary sectional view taken on line 8—8, FIG. 4.

Sidewall 64 of cup-shaped body 62 will not be entirely cylindrical but will form a somewhat oval configuration as shown in FIG. 8 wherein a part of the actual sidewall will engage and slide along inner surface 66 of cup drop sleeve 50. However, the amount of distortion which occurs to the just formed cup-shaped body and in particular to cylindrical sidewall 64 thereof as shown in FIG. 8, will be considerably less than that occurs in the prior art drop sleeves wherein the internal diameter of the cup drop sleeve was at least equal to or considerably larger than the outer diameter of the just formed cup-shaped body.

It has been found that by forming the internal diameter (Id) of sleeve 50 to a dimension just slightly more than the desired outer diameter (Od) of the just formed cup-shaped body cylindrical sidewall 64 provides increased uniformity and more accurately controlled dimensions by enabling the metal to set up by retarding the natural tendency of the metal to spring outwardly as it moves through opening 68 of drop sleeve 50.

Figure 5:
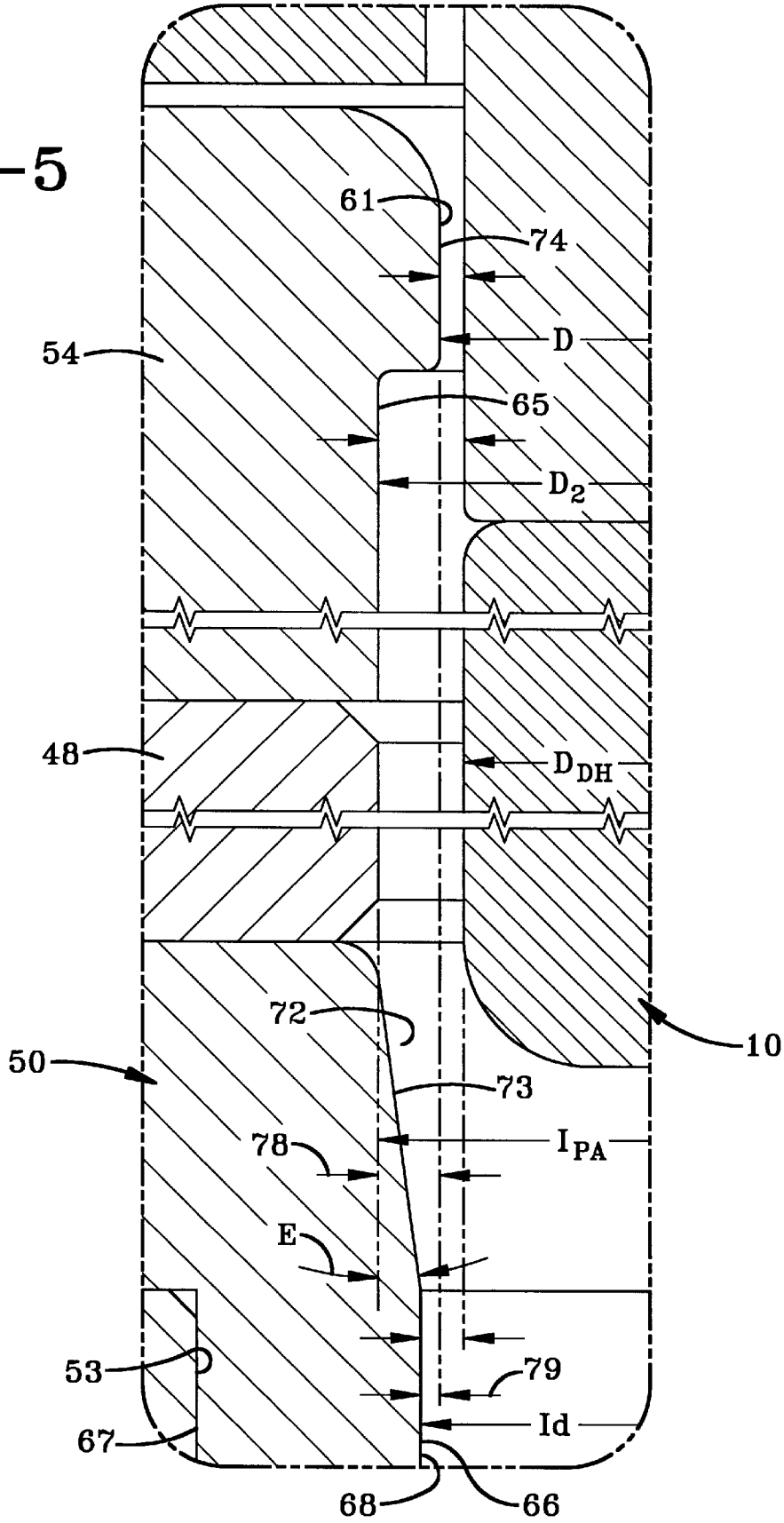
FIG. 5 is a greatly enlarged fragmentary sectional view of a portion of the blank and draw die and draw horn located therein, and the upper portion of the cup drop sleeve, showing the various dimensions and spacing between these components.
Figure 7:
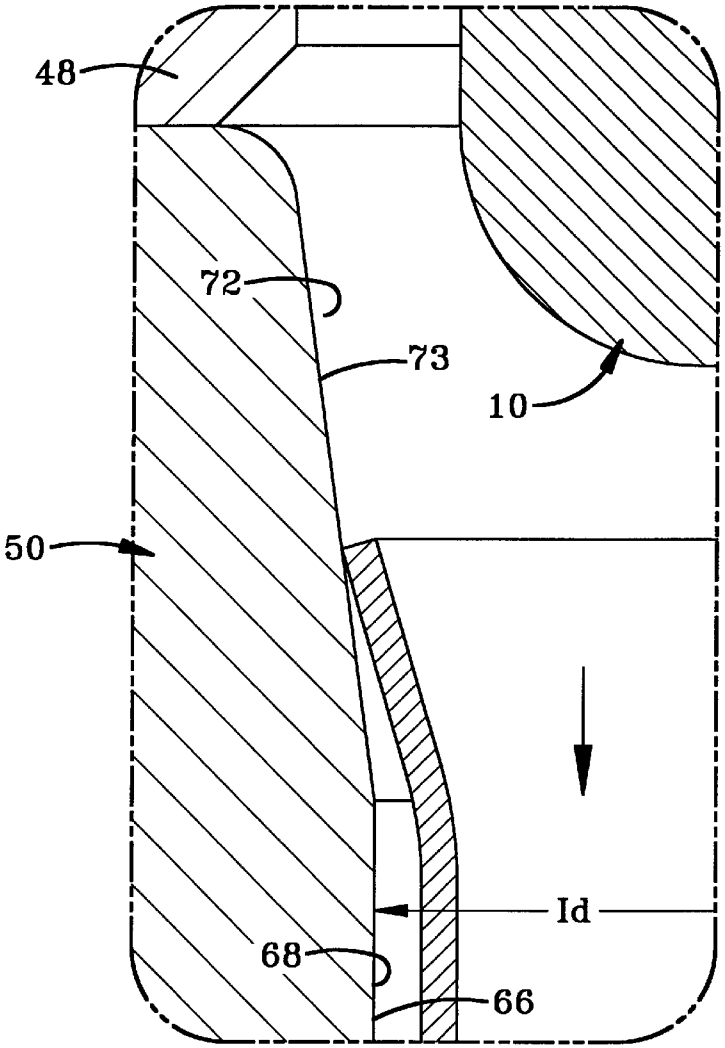
FIG. 7 is a greatly enlarged fragmentary sectional view of the lower portion of FIG. 5 showing the cup-shaped member moving through the start of the cup drop sleeve.
Figure 6:
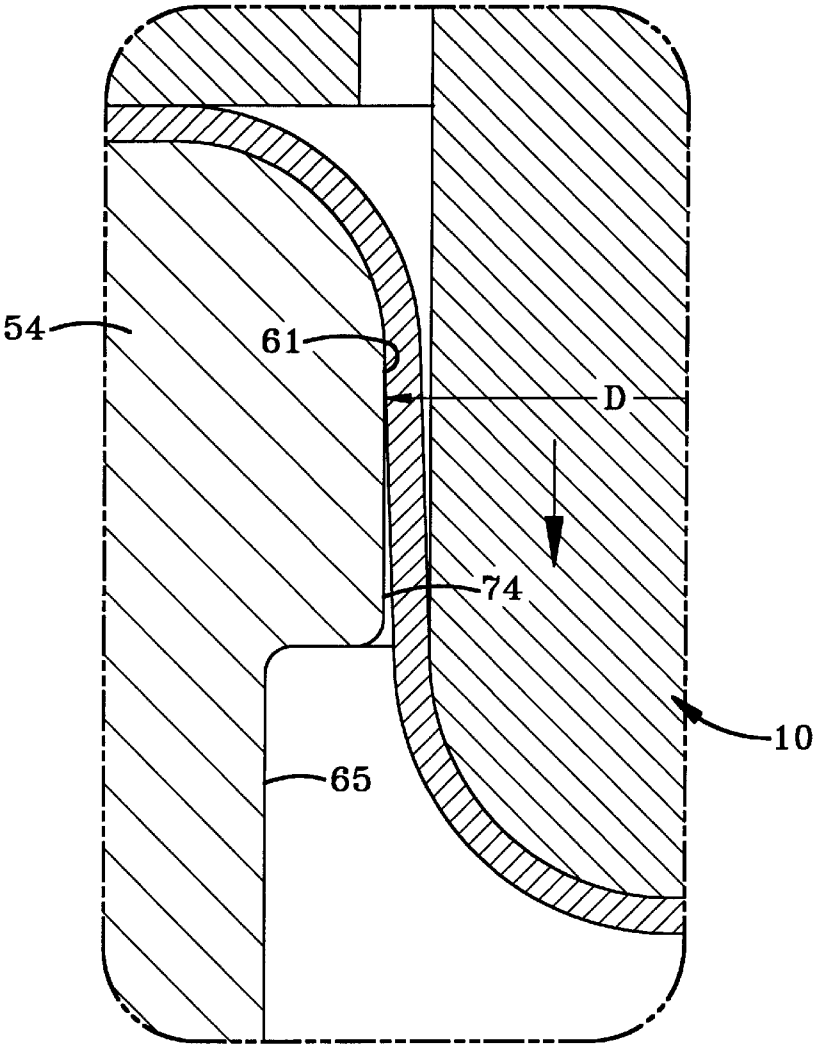
FIG. 6 is a still further enlarged fragmentary sectional view showing the initial forming of the cup-shaped member by the draw horn pushing the metal around the die radius.
Figure 9:
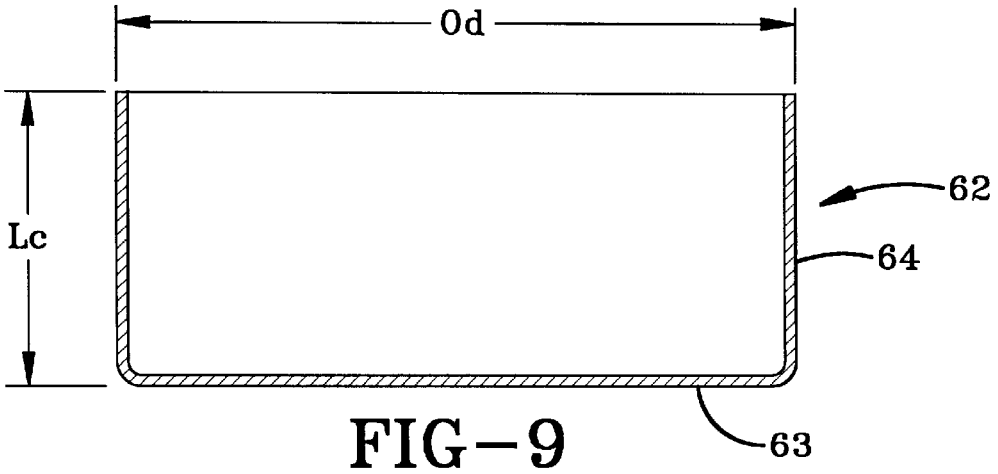
FIG. 9 is an enlarged sectional view of a cup-shaped container body produced by the method and apparatus of the present invention.

Preferably, the entrance end opening 72 of cup drop sleeve opening or bore 68 has an annular outwardly tapered segment 73, preferably tapered at an angle of between 6° and 10°, and preferably 8° as indicated by arrow E in FIG. 5. This assists in guiding cup-shaped body 62 into bore 68 as it is ejected off of draw horn 10 by the pressurized air. The outer diameter (Od) of cup-shaped body 62 is determined by the distance D or diameter between the annular forming surface 74 (FIGS. 2 and 5) of blank and draw die 54. Die opening 61 also is formed by a second cylindrical inner wall 65 located adjacent surface or wall 74 and having an inner diameter ($D_2$) which is at least 0.050 inches greater than diameter (D) of wall 74. In a typical cup forming procedure, internal diameter (Id) of drop sleeve 50 will be approximately 0.060 less than the diameter D. The axial length (L) of drop sleeve 50 (FIG. 2), and in particular bore 68, will have a length that is approximately twice the length (Lc) of cylindrical cup sidewall 64 (FIG. 9).

As shown particularly in FIG. 3 and FIG. 4, draw horn 10 does not force cup-shaped body 62 through sleeve 50 so as to perform any type of redraw or ironing function thereon since the cup is forced through bore 68 of the drop sleeve almost entirely by the pressurized air. Even though the movement of the cup-shaped body through drop sleeve 50 is a fraction of a second, the reduction in the inner diameter (Id) of the drop sleeve with respect to the outer diameter (Od) of the cup-shaped cylindrical sidewall has been found to increase the roundness of the cylindrical can body by retarding the natural spring back tendency of the just stamped blank body from the flat sheet metal strip.

In the preferred embodiment, the bore or opening 66 of drop sleeve 50 will have an internal diameter (Id) between 0.040 inches and 0.001 inches greater than the diameter (D) of the blank and draw die opening 74. This difference preferably is approximately 0.020 inches. This relationship enables cup-shaped body 62 to be formed from a usual metal strip such as aluminum, which will have the thickness in the range of between 0.0100 and 0.011 inches with an outer diameter (Od) which will pass through drop sleeve opening 68 under the force of the pressurized air but having sufficient closeness to inner surface 66 to reduce the spring back effect of the metal providing for a more uniform and cylindrical cup-shaped body. This provides body 62 with substantially uniform thickness side and bottom wall thicknesses in the range of 0.0115 inches and 0.0100 inches since no appreciable thinning occurs in the metal during formation of body 62.

Referring to FIG. 5, the diameter of prior art cup drop sleeves would be that indicated as Ipa. Thus, it is readily seen that a considerably greater annular space shown between arrows 78 would be provided in the prior art drop sleeves than the reduced annular space as shown between arrows 79 of the present invention. It is this reduction in the annular space or inner diameter of the cup drop sleeve opening with respect to the diameter (D) of the die forming opening, which achieves the advantages of the present invention.

In a usual cup-shaped body forming press, the diameter ($D_{DH}$) of draw horn 10 is usually 0.001 inches plus the metal thickness less than the diameter (D) of the die forming opening 61. This relationship will preferably remain the same for the apparatus and method of the present invention with the advantages being achieved by reducing the internal diameter (Id) of the cup drop sleeve opening.

Accordingly, the improved method and apparatus for forming cup-shaped container bodies is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purpose and are intended to be broadly construed.

Moreover, the description and illustration of the invention is by way of example, and the scope of the invention is not limited to the exact details shown or described.

Having now described the features, discoveries and principles of the invention, the manner in which the improved method and apparatus for forming cup-shaped container bodies is constructed and used, the characteristics of the construction, and the advantageous, new and useful results obtained, the new and useful structures, devices, elements, arrangements, parts and combinations, are set forth in the appended claims.

I claim:

1. Apparatus for forming a cup-shaped container body from a metal sheet, said apparatus including a draw pad and a draw horn;

a blank and draw die mounted on a base in opposed relationship to the draw pad and draw horn, said die having a first cylindrical inner wall forming a cup forming opening, said wall opening having a diameter (D);

a cutting edge carried by ram means and surrounding the draw pad and draw horn for cutting a disk from the metal sheet;

means for applying a clamping force on the draw pad for clamping a periphery of the disk between the draw pad and blank and draw die and for drawing the disc-shaped blank into a generally cylindrical cup-shaped body;

a cup drop sleeve mounted in the base beneath the draw horn, said drop sleeve having a cylindrical inner surface having an internal diameter (Id) forming an opening, said (Id) being between 0.040 inches and 0.001 inches greater than the diameter (D) of the cup forming opening; and air ejection means for forcing the cup-shaped blank through the cup drop sleeve opening.

2. The apparatus defined in claim 1 in which the (Id) of the cup drop sleeve opening is 0.020 inches greater than the diameter (D) of the cup forming opening.

3. The apparatus defined in claim 1 in which the cylindrical inner surface of the cup drop sleeve terminates in an annular outwardly tapered segment which forms an entrance end opening for the cup drop sleeve opening located beneath the blank and draw die.

4. The apparatus defined in claim 3 in which the tapered segment has an angle of taper between 6° and 10°.

5. The apparatus defined in claim 4 in which the angle of taper is 8°.

6. The apparatus defined in claim 1 in which the ram means includes an inner ram and an outer ram; and in which the draw paid is carried by the outer ram and the draw horn is carried by the inner ram.

7. The apparatus defined in claim 1 in which the draw horn is formed with at least one opening; and in which the air ejection means include pressurized air which is ejected through said draw horn opening.

8. The apparatus defined in claim 1 in which the base is formed with a cylindrical opening; and in which the cup drop sleeve includes a cylindrical outer surface which is slidably received within said cylindrical opening of the base.

9. The apparatus defined in claim 1 in which the blank and draw die includes a second cylindrical inner wall forming a part of the cup forming opening located adjacent the first cylindrical wall; and in which the second cylindrical inner wall has a diameter ($D_2$) which is at least 0.050 inches greater than the diameter (D) of the first inner cylindrical wall.

10. The apparatus defined in claim 1 in combination with the cup-shaped container body having a disk-shaped bottom wall and a cylindrical sidewall; and in which the cup drop sleeve has an axial length (L) approximately twice the axial length of the cylindrical sidewall of the container body.

11. The apparatus and container body combination defined in claim 10 in which the cup-shaped body bottom wall and sidewalls each have a thickness in the range of 0.0115 inches and 0.0100 inches.

12. The apparatus and container body combination defined in claim 11 in which the container body is formed of aluminum.

13. A method of forming a cup-shaped member from a metal sheet in a single continuous stroke of a press, including the steps of:

feeding the metal sheet between a blank and draw die and an aligned draw horn, a pressure-actuated draw pad and a cut edge;

providing the blank and draw die with a cup forming opening formed by a first cylindrical inner wall having a diameter (D);

providing a cup drop sleeve with a cylindrical inner opening formed by a cylindrical inner surface aligned with the draw horn, said opening having an inner diameter (Id);

advancing the cut edge and draw pad toward the metal sheet and the blank and draw die and blanking a disk from the metal sheet;

clamping a periphery of the disk between the draw pad and the blank and draw die;

advancing the draw horn towards the blank and draw die;

drawing the cup-shaped member from the disk by the advancement of the draw horn into the cup forming opening of the blank and draw die;

forcing the cup-shaped member through the cylindrical inner opening formed in the cup drop sleeve by directing a flow of pressurized air against the cup-shaped member; and forming the inner diameter (Id) of the cup drop sleeve greater than the diameter (D) of the blank and draw die opening by an amount within the range of 0.040 inches and 0.001 inches.

14. The method defined in claim 13 including the step of maintaining the entire axial length of the cup-shaped member completely within the cylindrical inner opening of the cup drop sleeve before the bottom wall of said member moves through a discharge bottom opening of the drop sleeve.

15. The method defined in claim 13 including the step of providing the drop sleeve opening with an axial length of approximately twice the axial length of the cup-shaped member.

16. The method defined in claim 13 including the step of providing the cup drop sleeve opening with a tapered entrance segment.

17. The method defined in claim 16 including the step of providing the entrance segment of the cup drop sleeve with a taper of between 6° and 10°.

18. The method defined in claim 13 including the step of providing the cup drop sleeve opening with a diameter (Id) approximately 0.020 inches greater than the diameter (D) of the cup forming opening of the blank and draw die.

19. The method defined in claim 13 including the step of providing the metal sheet with a thickness in the range of between 0.0100 and 0.0115 inches.

20. The method defined in claim 19 including the step of providing the metal sheet with a thickness of approximately 0.011 inches.

* * * * *